US005737982A

United States Patent [19]

Lin

[11] Patent Number: 5,737,982

[45] Date of Patent: Apr. 14, 1998

[54] RATCHET TOOL CONTROL MECHANISM

[76] Inventor: Jack Lin, No 103, Nan Kang 3 Road, Nan Kang Industrial Areas, Nan Tou, Taiwan

[21] Appl. No.: 726,966

[22] Filed: Oct. 7, 1996

[51] Int. Cl.[6] ..... B25B 13/06

[52] U.S. Cl. ..... 81/58.3; 81/63.1; 81/177.9; 192/43

[58] Field of Search ..... 192/43, 46; 81/58.3, 81/60, 63.1, 177.8, 177.9

[56] References Cited

U.S. PATENT DOCUMENTS 2,292,238 8/1942 Krieger ..... 81/58.3 X 5,329,834 7/1994 Wong ..... 81/58.3

*Primary Examiner*—James G. Smith

*Attorney, Agent, or Firm*—Charles E. Baxley, Esq.

[57] ABSTRACT

A ratchet tool includes a hand grip and a member rotatably coupled together. The member has an interior for receiving a shaft and has a channel for slidably receiving a knob. A barrel is rotatably engaged on the shaft and is slidably engaged in the member for allowing the barrel to be moved axially within the member. The barrel includes a number of ratchet teeth formed in front portion and the rear portion. The knob includes a stud engaged with the barrel for moving the barrel along the shaft. Two followers are engaged on the shaft and rotated in concert with the shaft and each includes a number of ratchet teeth for engaging with the ratchet teeth of the barrel and for allowing the followers to be rotated in an active direction by the barrel. The ratchet teeth are in surface engagement such that the followers may be solidly driven by the ring.

4 Claims, 3 Drawing Sheets

RATCHET TOOL CONTROL MECHANISM

BACKGROUND OF THE INVENTION

1. Field of the Invention

The present invention relates to a control mechanism, and more particularly to a ratchet tool control mechanism.

2. Description of the Prior Art

Typical ratchet tools, especially ratchet screw drivers comprise a pair of pawls engaged with the peripheral teeth of a gear for controlling the acting directions of the screw drivers. However, the pawls are in line contact with the teeth of the gear such that both the teeth of the gear and the pawls may be easily damaged.

The present invention has arisen to mitigate and/or obviate the afore-described disadvantages of the conventional ratchet tools.

SUMMARY OF THE INVENTION

The primary objective of the present invention is to provide a ratchet tool which includes a barrel having a number of ratchet teeth in surface contact with the ratchet teeth of two followers for allowing the followers to be effectively driven.

In accordance with one aspect of the invention, there is provided a ratchet tool comprising a hand grip, a body including a rear portion secured to the hand grip and a front portion, the front portion of the body including an interior formed therein and including a peripheral portion having a channel formed therein, the body including at least one longitudinal rib formed therein, a shaft rotatably received in the interior of the body, the shaft including a non-circular cross section, a pair of retaining rings secured on the shaft, a barrel including a bore rotatably engaged on the shaft, the bore including a size greater than that of the shaft for allowing the barrel to be rotated relative to the shaft, the barrel including at least one slot for engaging with the longitudinal rib of the body and for allowing the barrel to be moved axially within the body, the barrel including a front portion and a rear portion each having a plurality of first ratchet teeth formed thereon, the bore of the barrel including a size greater than that of the retaining rings for preventing the retaining rings from engaging with the barrel, a knob slidably engaged in the channel of the body and including a stud extended inward of the body and engaged with the barrel for moving the barrel along the shaft, a first and a second followers engaged on the shaft and engaged with the front portion and the rear portion of the barrel respectively, the followers each including a non-circular bore for engaging with the shaft and for allowing the followers to be rotated in concert with the shaft, the followers each including a plurality of second ratchet teeth formed thereon for engaging with the first ratchet teeth of the barrel and for allowing the followers to be rotated in an active direction by the barrel respectively, and means for biasing the first and the second followers to engage with the barrel respectively. The retaining rings are engaged with the first and the second followers for allowing only one of the first and the second followers to be engaged with the barrel.

The rear portion of the body includes a pair of ears extended therefrom for defining a space therebetween, a coupler includes a projection engaged in the space, an axle is engaged through the ears and the projection of the coupler for pivotally coupling the coupler to the ears of the body, the ears each includes a semicircular free end having a plurality of third teeth formed thereon, the coupler includes two cavities formed therein for receiving a pair of spring biased balls respectively and for allowing the bails to be engaged with the third teeth of the ears and for positioning the coupler at an angular position relative to the body.

The body includes a middle portion having a pin engaged therein, the shaft includes an annular groove formed therein for engaging with the pin and for allowing the shaft to be rotated relative to the body and for preventing the shaft from moving axially relative to the body.

The body includes a middle portion having a stop formed thereon, a sleeve is engaged on the body and includes a notch for engaging with the stop of the body and for preventing the sleeve from rotating relative to the body, the sleeve includes an opening for engaging with the knob.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
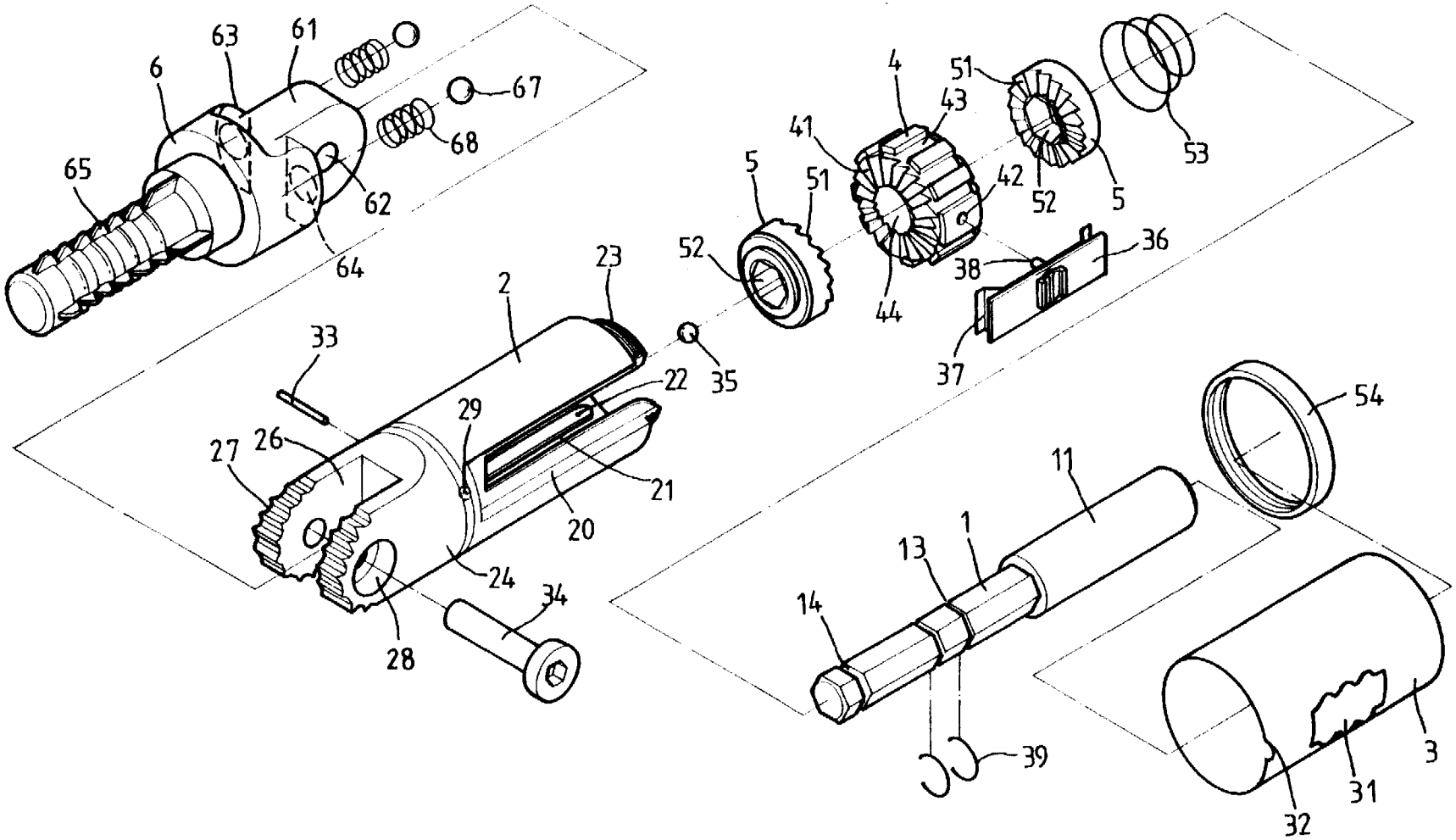
FIG. 1 is an exploded view of a ratchet tool in accordance with the present invention, in which the ratchet tool is seen from the rear portion thereof.
Figure 2:
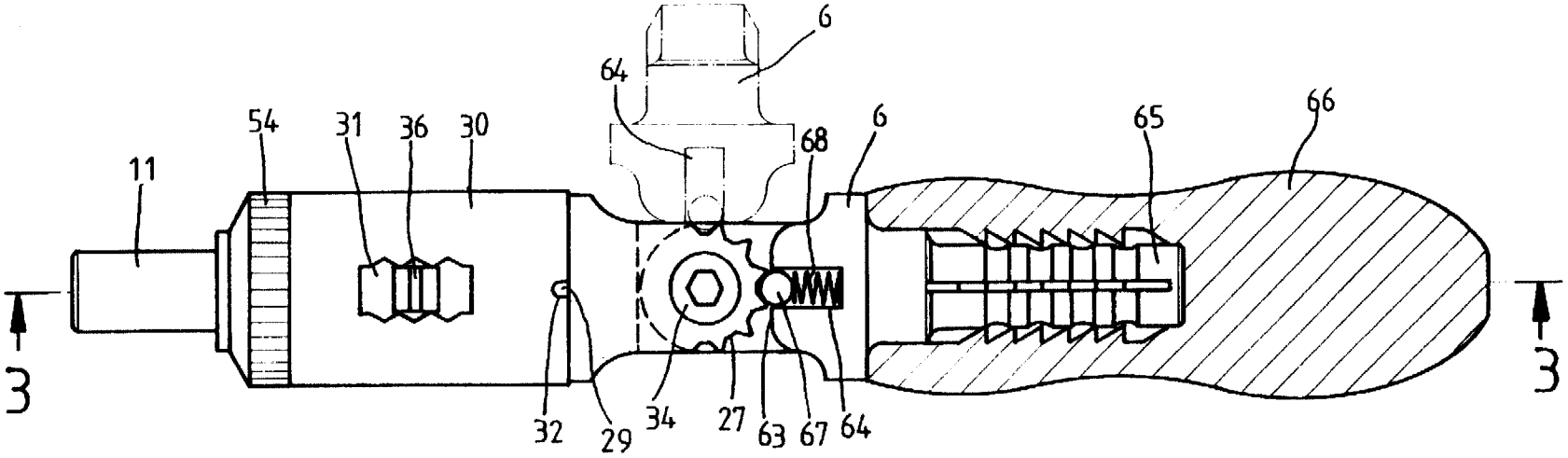
FIG. 2 is a front view of the ratchet tool, in which the handle portion has been partially cut off for showing the configuration of the handle.
Figure 3:
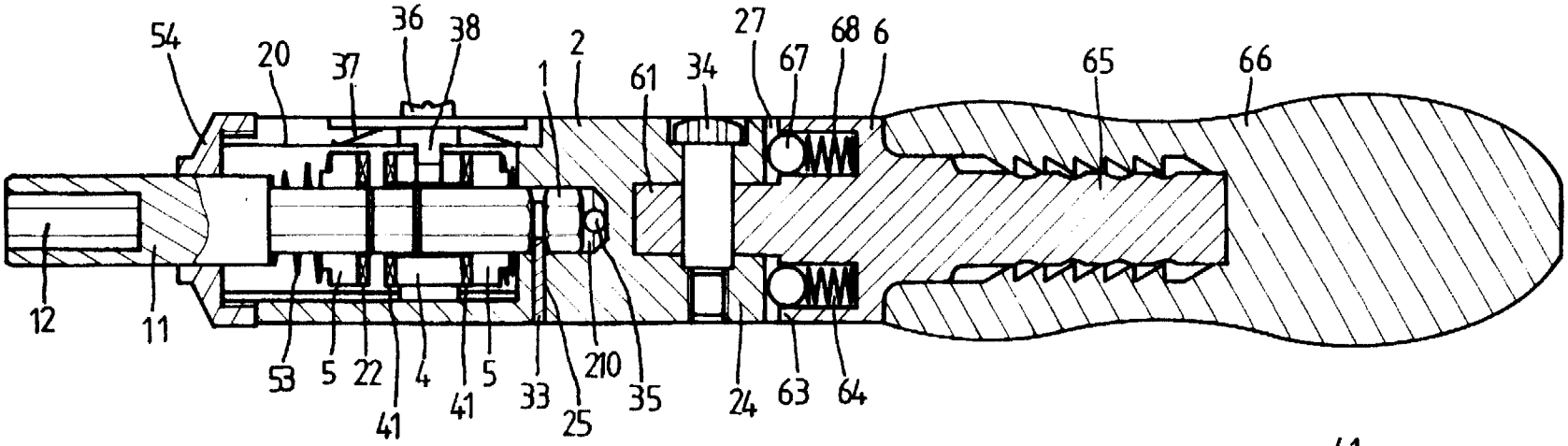
FIG. 3 is a cross sectional view taken along lines 3—3 of FIG. 2.

Referring to the drawings, and initially to FIGS. 1 to 3, a ratchet tool in accordance with the present invention comprises a body 2 including a pair of ears 24 extended rearward therefrom for defining a space 26 therebetween for receiving a projection 61 of a coupler 6. The ears 24 each includes a semi-circular free end having a number of teeth 27 formed thereon and each includes a hole 28 formed therein for engaging with an axle 34 which is engaged through a hole 62 of the projection 61 of the coupler 6 for allowing the coupler 6 to be rotatably coupled to the ears 24 of the body 2. The coupler 6 includes two shoulders 63 each having a cavity 64 formed therein for receiving a spring 68 and a ball 67 therein. The balls 67 are engaged with the teeth 27 of the ears 24 for positioning the coupler 6 at any suitable angular position relative to the body 2. The coupler 6 includes a stem 65 extended rearward therefrom for engaging with a hand grip 66 and for allowing the hand grip 66 to be rotated about the axle 34.

The body 2 includes a channel 20 formed in the front and peripheral portion for slidably receiving a knob 36 which includes a pair of resilient blades 37 and a stud 38 extended inward of the body 2 through the channel The body 2 includes a middle portion having a stop 29 formed thereon and having a pin 33 engaged therein. The body 2 includes an interior 21 formed in the front portion for receiving a shaft 1 therein and includes a depression 210 formed in the inner portion for receiving a bearing or a ball 35 therein (FIG. 3). The shaft 1 includes an annular groove 14 formed in the rear end thereof for engaging with the pin 33 which limits the shaft 1 to be rotatable within the body 2 and which prevents the shaft 1 from moving axially relative to the body 2. The body 2 includes a number of longitudinal ribs 22 formed in the interior 21 and includes an outer thread 23 formed in the front portion thereof for engaging with a cap 54. The shaft 1 includes a pair of annular grooves 13 formed therein for engaging with a pair of retaining rings 39. The shaft 1 includes a non-circular cross section, such as a hexagonal cross section, and includes a front portion 11 having an engaging hole 12 formed therein (FIG. 3 ) for engaging with a fastener or a typical connecting rod. A sleeve 3 is engaged on the body 2 and includes a notch 32 for engaging with the stop 29 of the body 2 which may prevents the sleeve 3 from rotating relative to the body 2. The sleeve 3 includes an opening 31 for engaging with the knob 36 and for allowing the knob 36 to be operated from the outside of the sleeve 3.

Figure 4:
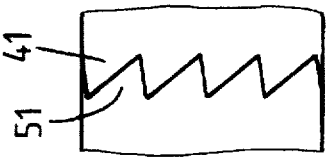
FIG. 4 is an enlarged partial plane view illustrating the engagement of the ratchet teeth.

A barrel 4 includes a bore 44 engaged on the shaft 1 for allowing the barrel 4 to be rotated relative to the shaft 1. The bore 44 has a size greater than that of the retaining rings 39 such that the retaining rings 39 will not be engaged with the barrel 4. The barrel 4 includes a hole 42 for engaging with the stud 38 of the knob 36 and for allowing the barrel 4 to he moved axially along the shaft 1 by the knob 36. The barrel 4 includes a number of slots 43 formed in the outer peripheral surface thereof for engaging with the longitudinal ribs 22 of the body 2 and for allowing the barrel 4 to be moved axially within the body 2 only. The barrel 4 includes a front portion and a rear portion each having a number of ratchet teeth 41 formed thereon. Two followers 5 are engaged on the shaft 1 and each includes a hexagonal bore 52 for engaging with the shaft 1 such that the followers 5 are rotated in concert with the shaft 1. The followers 5 each includes a number of ratchet teeth 51 formed thereon for engaging with the ratchet teeth 41 of the barrel 4 (FIG. 4). The retaining rings 39 may engage with the followers 5 for limiting the movement of the followers 5 (FIG. 3). One spring 53 is engaged between the front portion 11 of the shaft 1 and one of the follower 5 and the other spring 53 is engaged between the other follower 5 and the body 2 for biasing the followers 5 to engage with the barrel 4 (FIG. 3). However, the retaining rings 39 may engage with the followers 5 and may allow only one of the followers 5 to be engaged with the barrel 4.

In operation, as shown in FIG. 3, when the barrel 4 is moved rightward by the knob 36 to engage with the right follower 5, the hand grip 66 and the coupler 6 and the body 2 may rotate the barrel 4 which may rotate the follower 5 and the shaft 1 in an active direction due to the engagement of the ratchet teeth 41, 51 of the barrel 4 and of the follower 5. At this moment, the left follower 5 is engaged with the left retaining ring 39 which may prevent the left follower 5 from engaging with the barrel 4. On the contrary, when the barrel 4 is moved leftward to engage with the left follower 5, the shaft 1 and the left follower 5 may be rotated in another active direction by the barrel 4 and the body 2 and the coupler 6 and the hand grip 66.

It is to be noted that the barrel 4 includes a number of slots 43 for engaging with the longitudinal ribs 22 of the body 2 such that the barrel 4 may be solidly rotated by the body 2. The knob 36 includes a stud 38 solidly engaged with the barrel 4 such that the barrel 4 may be effectively moved by the knob 36. Furthermore, the engagement between the ratchet teeth 41, 51 (FIG. 4) is a surface engagement such that the followers 5 may be solidly and effectively rotated by the barrel 4.

Accordingly, the ratchet tool in accordance with the present invention includes a barrel having a number of ratchet teeth in surface contact with the ratchet teeth of two followers for allowing the followers to be effectively driven.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a hand grip, a body including a rear portion secured to said hand grip and a front portion, said front portion of said body including an interior formed therein and including a peripheral portion having a channel formed therein, said body including at least one longitudinal rib formed therein, a shaft rotatably received in said interior of said body, said shaft including a non-circular cross section, a pair of retaining rings secured on said shaft, a barrel including a bore rotatably engaged on said shaft, said bore including a size greater than that of said shaft for allowing said barrel to be rotated relative to said shaft, said barrel including at least one slot for engaging with said longitudinal rib of said body and for allowing said barrel to be moved axially within said body, said barrel including a front portion and a rear portion each having a plurality of first ratchet teeth formed thereon, said bore of said barrel including a size greater than that of said retaining rings for preventing said retaining rings from engaging with said barrel, a knob slidably engaged in said channel of said body and including a stud extended inward of said body and engaged with said barrel for moving said barrel along said shaft, a first and a second followers engaged on said shaft and engaged with said front portion and said rear portion of said barrel respectively, said followers each including a non-circular bore for engaging with said shaft and for allowing said followers to be rotated in concert with said shaft, said followers each including a plurality of second ratchet teeth formed thereon for engaging with said first ratchet teeth of said barrel and for allowing said followers to be rotated in an active direction by said barrel respectively, and means for biasing said first and said second followers to engage with said barrel respectively, said retaining rings being engaged with said first and said second followers for allowing only one of said first and said second followers to be engaged with said barrel.

2. A ratchet tool according to claim 1, wherein said rear portion of said body includes a pair of ears extended therefrom for defining a space therebetween, a coupler includes a projection engaged in said space, an axle is engaged through said ears and said projection of said coupler for pivotally coupling said coupler to said ears of said body, said ears each includes a semicircular free end having a plurality of third teeth formed thereon, said coupler includes two cavities formed therein for receiving a pair of spring biased balls respectively and for allowing said balls to be engaged with said third teeth of said ears and for positioning said coupler at an angular position relative to said body.

3. A ratchet tool according to claim 1, wherein said body includes a middle portion having a pin engaged therein, said shaft includes an annular groove formed therein for engaging with said pin and for allowing said shaft to be rotated relative to said body and for preventing said shaft from moving axially relative to said body.

4. A ratchet tool according to claim 1, wherein said body includes a middle portion having a stop formed thereon, a sleeve is engaged on said body and includes a notch for engaging with said stop of said body and for preventing said sleeve from rotating relative to said body, said sleeve includes an opening for engaging with said knob.

* * * * *